US006269797B1

(12) United States Patent
Uchida

(10) Patent No.: US 6,269,797 B1
(45) Date of Patent: Aug. 7, 2001

(54) CYLINDER HEAD AND MANIFOLD ARRANGEMENT FOR INJECTED ENGINE

(75) Inventor: Masahiro Uchida, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/195,795

(22) Filed: Nov. 19, 1998

(30) Foreign Application Priority Data

Nov. 19, 1997 (JP) ..... 9-318004

(51) Int. Cl.[7] ..... F02M 55/02
(52) U.S. Cl. ..... 123/469; 123/468
(58) Field of Search ..... 123/468, 469, 123/470, 456, 472

(56) References Cited

U.S. PATENT DOCUMENTS 4,307,693 * 12/1981 Glockler ..... 123/469
4,932,368 * 6/1990 Abe ..... 123/470
5,074,269 * 12/1991 Herbon ..... 123/468
5,156,124 * 10/1992 Sugimoto ..... 123/470
5,197,436 * 3/1993 Ozawa ..... 123/468
5,839,400 * 11/1998 Vattaneo ..... 123/470
5,894,831 * 4/1999 Takahashi ..... 123/470
6,019,089 * 2/2000 Taylor ..... 123/470

FOREIGN PATENT DOCUMENTS

404350356 * 12/1992 (JP) ..... 123/469

* cited by examiner

*Primary Examiner*—Carl S. Miller
(74) *Attorney, Agent, or Firm*—Ernest A. Beutler

(57) ABSTRACT

A cylinder head, air intake manifold, fuel injector and fuel rail arrangement for an overhead valve engine that provides a compact assembly. The fuel rail is attached to the cylinder head by fasteners that extend parallel to the fasteners that fix the intake manifold to an adjacent portion of the cylinder head. The layout is such, however, that there is no interference between the various components and thus accessibility is improved while cost is minimized.

15 Claims, 3 Drawing Sheets

CYLINDER HEAD AND MANIFOLD ARRANGEMENT FOR INJECTED ENGINE

BACKGROUND OF THE INVENTION

This invention relates to an injected internal combustion engine and more particularly to an air manifold and fuel rail mounting arrangement for such engine.

The use of fuel injection in place of carburetors is being widely accepted in most applications for internal combustion engines. One convenient and relatively low-cost type of injection system employs what is referred to as "manifold injection." With this type of arrangement, fuel is injected into the induction system preferably at a point quite close to the intake port of the engine.

With four-cycle engines, this generally means that the fuel injector is mounted in the cylinder head and injects fuel into the intake passage at a point that is located close to the intake valve seat and may, in fact, be directed directly toward that valve seat. This generally means that the fuel injector is mounted quite close to the area of attachment of the intake manifold to the cylinder head. This gives rise to certain problems in connection with the mounting of the various components to the cylinder head to ensure against interference between the various mounting arrangements.

It is, therefore, a principal object of this invention to provide an improved mounting arrangement for the components of a fuel injected, internal combustion engine.

It is a further object of this invention to provide an improved mounting arrangement for the components of a manifold injected engine where the fuel injectors spray into the cylinder head intake passages.

Frequently, it has been the practice to supply the fuel to the fuel injectors through a device that is referred to as a "fuel rail." A fuel rail is actually a form of manifold that delivers fuel from a high pressure source to the individual fuel injectors. Many times, it has been the practice to mount the fuel rail directly to the injectors and not attach it permanently to any component of the engine other than through its hydraulic connections to the fuel supply system. However, this can give rise to the likelihood or possibility of the fuel rail working itself loose, particularly if the engine is subjected to vibrations in use.

It has, therefore, been proposed to fasten the fuel manifold or fuel rail also to the engine body on which the fuel injectors are mounted. This obviously gives rise to further problems in connection with attachment of the components including the fuel rail.

It is, therefore, a further object of this invention to provide an improved arrangement for attaching a fuel rail to an engine.

It is a still further object of this invention to provide an improved mounting arrangement for the fuel rail of a manifold injected engine where the fuel rail is mounted in close proximity to the intake manifold attachment to the cylinder head.

Because of the fact that the fuel injectors are disposed generally at an angle to the portion of the intake passage which they intersect, in order to provide the desired flow direction, then the normal positioning of the fuel rail is such that its hold-down fasteners extend at a different angle to the associated surface of the cylinder head than the fasteners that hold the intake manifold in place. This requires sequential machining operations and adds to the cost of manufacturing the various cylinder head assembly.

It is, therefore, a still further object of this invention to provide an improved arrangement for holding down the fuel rail and intake manifold to a cylinder head of an engine wherein the threaded fasteners for each can extend along parallel axis to simplify machining.

SUMMARY OF THE INVENTION

This invention is adapted to be embodied in a fuel injected internal combustion engine that is comprised of a cylinder head having a plurality of intake passages. An air intake manifold is attached to the cylinder head and supplies air to the intake passages of the cylinder head. A plurality of fuel injectors are mounted in the cylinder head and are positioned in proximity to the intake passages for spraying fuel directly into the intake passages. A fuel rail supplies fuel to these fuel injectors. The fuel rail is affixed to the cylinder head in proximity to the air intake manifold. The fuel rail is connected to the cylinder head by threaded fasteners that are disposed in the area between the fuel injector and the intake manifold so that the threaded fasteners for the fuel rail do not interfere with the attachment of the intake manifold to the cylinder head.

DETAILED DESCRIPTION OF THE PREFERRED EMBODIMENT

Figure 1:
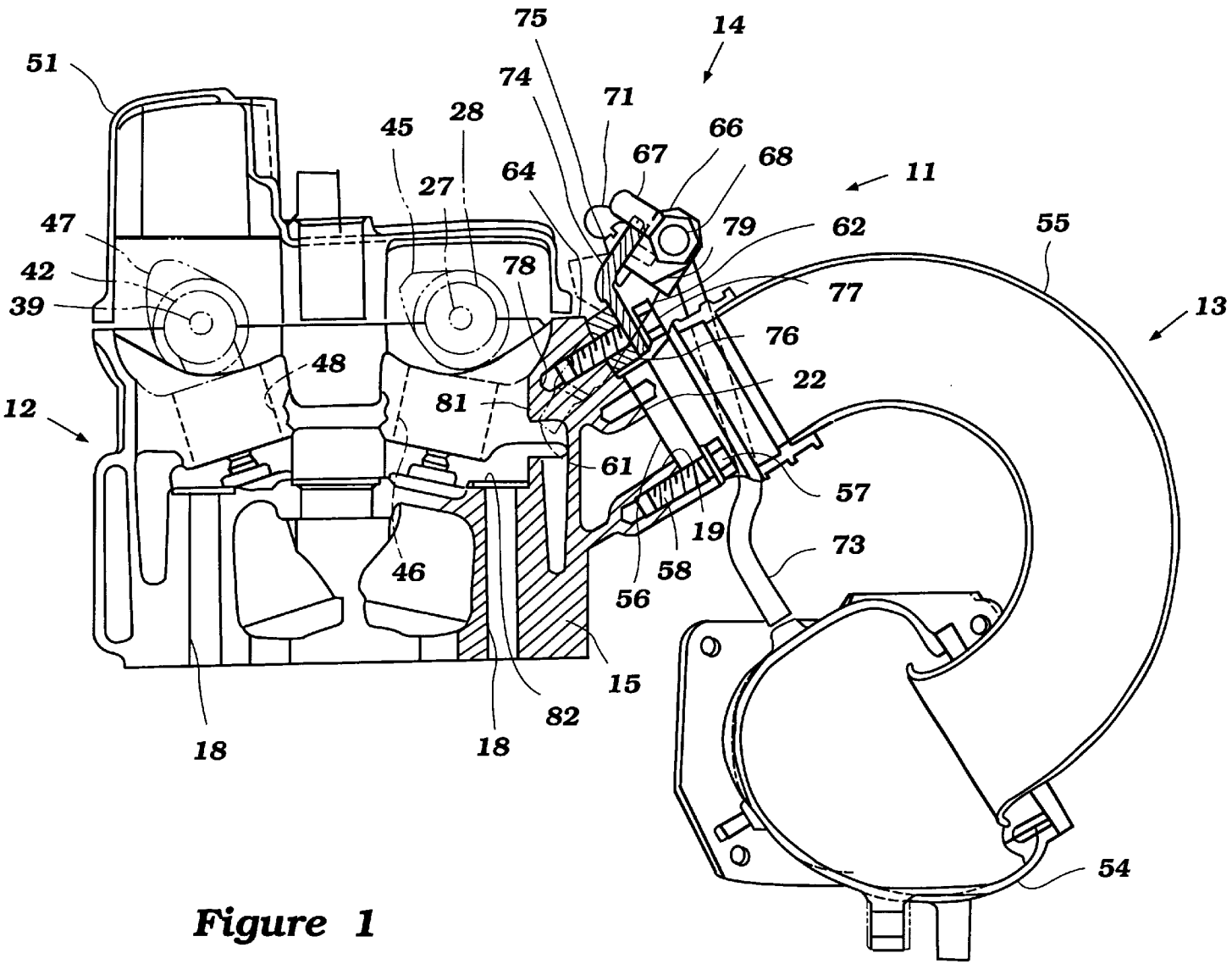
FIG. 1 is an end elevational view of the cylinder head and attached components of an internal combustion engine, with portions broken a way and shown in section.

In the drawings, an internal combustion engine constructed in accordance with an embodiment of the invention is shown in part and is indicated generally by the reference numeral 11. The engine 11 includes a cylinder head assembly 12 to which an air intake manifold assembly, indicated generally by the reference numeral 13 is affixed in a suitable manner. In addition, a fuel injection system, indicated generally by the reference numeral 14, is affixed to the cylinder head assembly 12 adjacent the intake manifold 13 for injecting fuel into the induction system of the engine 12.

Since the invention relates primarily to the relationship of the cylinder head, air intake manifold assembly 13 and fuel injection system 14, an illustration of the cylinder block, crankshaft and other internal portions of the engine below the cylinder head assembly 12 is not believed to be necessary to permit those skilled in the art to practice the invention. Where any components of the overall engine 11 are not illustrated or described, any conventional or known structure may be employed.

The cylinder head assembly 12 is comprised of a main cylinder head casting 15 which may be cast from aluminum or aluminum alloy or any other suitable material. This casting 15 is formed in its lower face with recesses 16 (FIG. 3) that cooperate with the associated cylinder bores of the cylinder block and the pistons that reciprocate therein to form the combustion chamber to the engine 11.

In the illustrated embodiment, the engine 11 is depicted as being of a four-cylinder inline type. It will be readily apparent to those skilled in the art, however, that the invention can be employed with engines having any number of cylinders and any desired cylinder arrangement such as V-type engines or the like.

The combustion chamber recesses 16 are formed in a planar lower surface 17 of the cylinder block casting 15 which surface is held in sealing arrangement with the associated cylinder block via threaded fasteners that pass through fastener receiving openings 18 formed in the cylinder head casting 15 in spaced relationship around the combustion chamber recesses 16.

The cylinder head casting 15 is formed on one side (the right hand side in the illustrated embodiment) with an intake passage arrangement, indicated generally by the reference numeral 19. In the specific example illustrated, the intake passage arrangement 19 is of the Siamese type for each cylinder having a common inlet opening 21 in an external surface 22 of the cylinder head casting 15. This passage arrangement 19 divides into a pair of passage portions 23, each of which terminates at a respective valve seat 24 in the cylinder head combustion chamber recess 16. These valve seats 24 may be formed in any suitable manner, as by pressed or bonded seat inserts 25.

Figure 2:
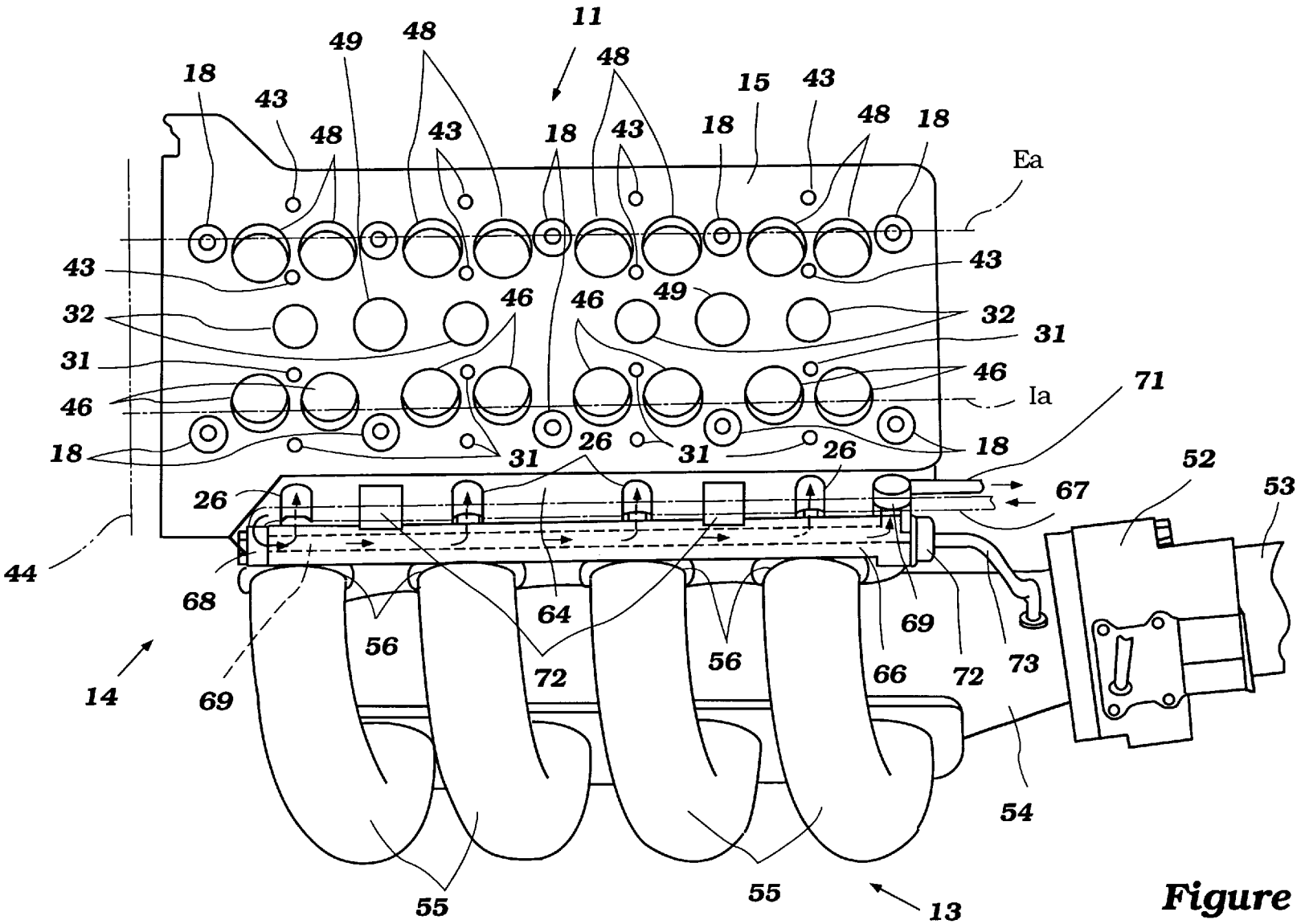
FIG. 2 is a top plan view of the components shown in FIG. 1 but with the camshaft, cam cover and valve mechanism removed from the cylinder head.
Figure 3:
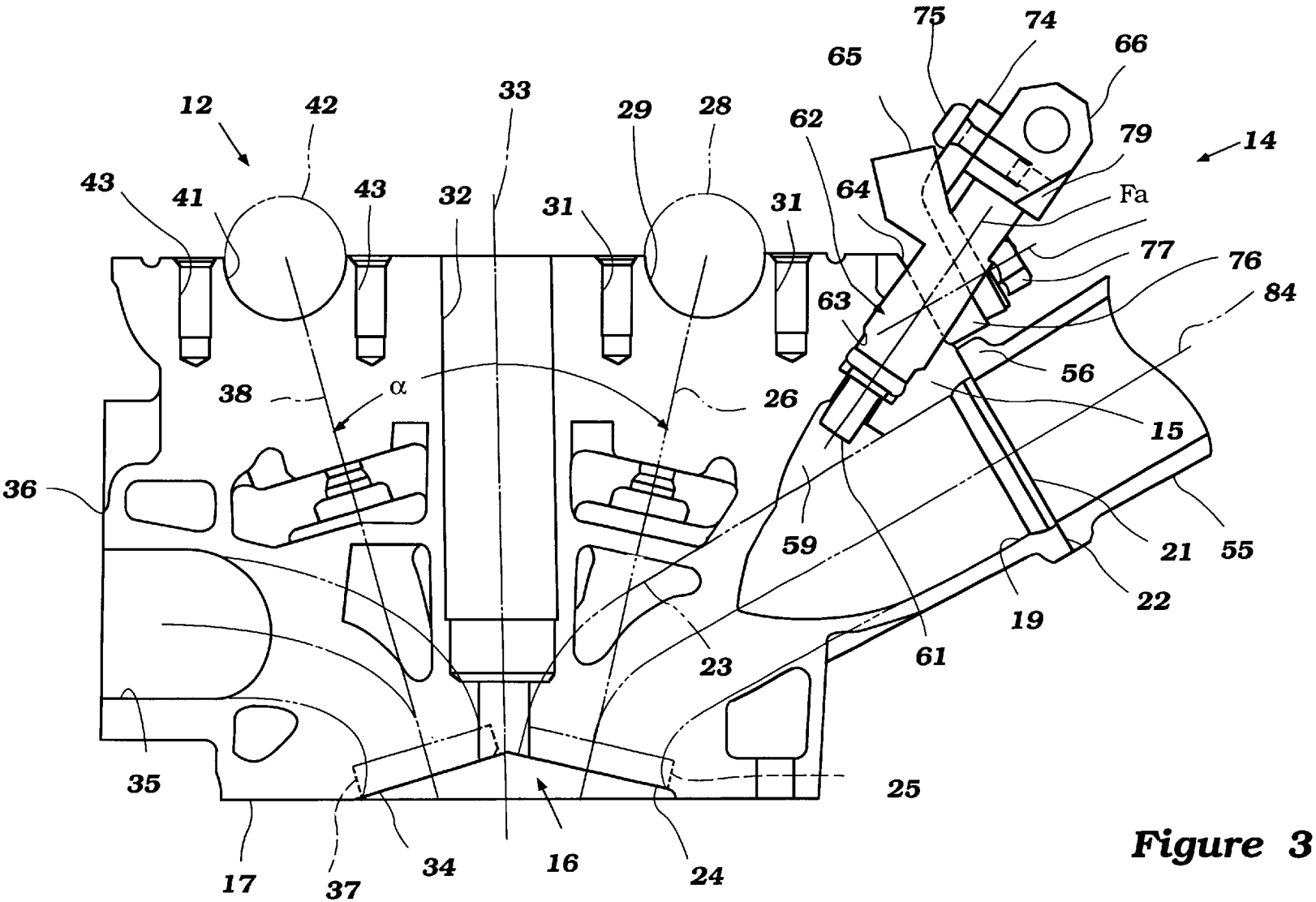
FIG. 3 is an enlarged cross-sectional view taken along a plane parallel to the plane of FIG. 1 that passes through the axis of one of the cylinder bores of the engine.

Intake valves, which appear only partially in FIG. 3 and which reciprocate about an axes 26 that lie in a common plane control the opening and closing of the intake valve seats 24. These intake valves are operated by a suitable mechanism, namely an overhead mounted intake camshaft 27 that has beating portions 28 that are journaled in bearing surfaces 29 machined directly in the cylinder head casting 15. Bearing caps (not shown) are affixed to the cylinder head casting 15 by means of threaded fasteners that are received in tapped openings 31 formed on opposite sides of the bearing portions 29 as may be seen in FIGS. 2 and 3. As seen in FIG. 3, the rotational axis of the intake camshaft 28 is indicated at Ia in FIG. 2. The valve axis line 26 intersects this axis.

Spark plugs (not shown) are mounted within spark plug wells 32 formed in the central portion of the cylinder head casting 15 and which define an axis 33 along which the received spark plug extends. This axis 33 is intersects substantially the center of the combustion chamber recess 16. Thus, a spark plug received therein will have its gap disposed in this area so as to ensure complete charge burning throughout the entirety of each combustion chamber.

A pair of exhaust valve seats 34 are formed in each cylinder head recess 16 and form the inlets to exhaust passages 35 which extend therefrom to outlet openings in an exterior surface 36 of the cylinder head casting 15. Like the intake passages 19, the exhaust passages 35 for each cylinder are Siamesed. The exhaust valve seats 34 are formed, like the intake valve seats 24, by suitable inserts 37 that are attached to the cylinder head casting 15 in a suitable manner.

Poppet type exhaust valves, which are not shown, are mounted in the cylinder head casting 15 in a suitable manner and reciprocate along respective exhaust valve axes 38. These exhaust valve axes 38 lie in a common plane that is disposed at an acute angle $\alpha$ to plane containing the intake valve axes 26.

The exhaust valves are operated by an exhaust camshaft 39 which is journaled in bearing surfaces 41 formed in the upper surface of the cylinder head casting 15. The exhaust camshaft 39 has bearing portions 42 that are journaled in the surfaces 41 and which are retained in place by bearing caps (not shown). These bearing caps are affixed to the cylinder head casting 15 by threaded fasteners that are threaded into tapped openings 43 formed in the cylinder head casting 15.

The intake camshaft 27 and exhaust camshaft 39 are driven by a suitable timing mechanism such as a chain, which is shown schematically in FIG. 2 and which is indicated by the reference numeral 44. The exhaust camshaft rotational axis is indicated by the broken lines Ea in this Figure.

The intake camshaft 27 has cam lobes 45 that cooperate with thimble tappets (not shown) slidably supported within bores 46 formed in the cylinder head casting 15 for operating the intake valves in a well known manner. In a like manner, the exhaust camshaft 39 has cam lobes 47 that cooperate with thimble tappets (also not shown) received in bores 48 formed in the cylinder head casting 15. As has been previously noted, the valve actuating mechanism may be of any known type and the foregoing description is merely exemplary.

Between the spark plug wells 32 at each end of the engine, there are provided a pair of clean-out openings 49 in the cylinder head casting 15. This is to permit removal of core sand. These openings 49 are then closed by freeze plug as is well known in this art.

The valve actuating mechanism described is enclosed by a cam cover 51 that is affixed in a suitable manner to the cylinder head casting 15.

The induction manifold 13 is served by an air inlet device which is not shown but which communicates with a throttle body 52 through an air supply duct 53. The throttle body 53 contains one or more throttle valves that are operated remotely by the operator and which control the flow of air into a longitudinally extending plenum device 54.

The plenum device 54 extends along one side of the engine and has a plurality of runner sections 55 emanating from it, one for each intake passage opening 21. The runners 55 have a re-entrant curvature and terminate at their discharge ends in respective flange portions 56 that have a pair of lugs that receive threaded fasteners 57. These fasteners 57 are threaded into tapped openings 58 formed in the cylinder head casting 15 on opposite sides of the openings 21 of the intake passages 19. These tapped openings 58 extend perpendicularly to the cylinder head surface 22.

The intake manifold 13 and its attachment to the cylinder head casting as thus far described may be considered to be conventional. The invention deals primarily with the fuel supply system 14 and its manner of attachment to the cylinder head casting 15 and its relationship to the induction system and specifically the flanges 56 of the manifold runners 55 and their attachment to the cylinder head surface 22. This structure will be described now.

It has been noted that the intake passages 19 are Siamesed. At a point where the passages merge upstream of the valve seats 26, there is provided a recess 59 in the cylinder head. A fuel injector nozzle portion 61 extend into this recess and sprays along a flow axis Sa directed generally in a downstream direction and toward the intake valve seats 24.

The fuel injector nozzle 61 forms a main portion of a fuel injector assembly 62 that is received within an injector opening 63 that is machined into a surface 64 of the cylinder head casting 15. This surface 64 is slightly offset from but parallel to the surface 22 to which the manifold flanges 56 are affixed.

The fuel injectors 62 are of the electrically operated type and have an actuating solenoid that is provided with a terminal 65 to which a wire harness (not shown) is affixed so as to control the timing of opening and closing of the injector valves thereof A fuel supply system supplies fuel to the fuel receiving nozzles of the injector 62 and this includes a main fuel rail 66. This main fuel rail 66 has complementary sealed openings that interconnect with the fuel receiving portions of the injector 62 so as to provide a leak-proof fuel supply thereto.

Fuel is delivered from a remote fuel tank through a pressure conduit 67 as best seen in FIG. 2. This pressure conduit 67 extends to the forward or cam drive end of the engine where it is connected to a banjo fitting 68. The banjo fitting 68 supplies fuel to a central flow passage 69 of the main fuel rail 66.

The opposite end of the main fuel rail 66 mounts a pressure regulator 69 which regulates pressure by dumping excess fuel back to the remote fuel tank through a return line 71. In order to ensure that the injected fuel is at a pressure that is at a fixed amount above the pressure of the air into which it is injected, the pressure regulator 69 has a portion 72 that receives air at the pressure in the plenum chamber 54 through a conduit 73. Hence, the pressure of the fuel injected is always maintained at a fixed value above the pressure of the air into which it is injected.

A pair of angularly shaped mounting bracket 74 are affixed to one side of the main fuel rail 66 in the area between adjacent injectors and between the manifold runners 55 as best seen in FIG. 2. These mounting brackets 74 may be formed from a non-metallic material such as a resinous plastic or the like. They are affixed to the main fuel valve 66 by threaded fasteners 75. The other leg of these brackets 74 engages a circular non-metallic washer 76 that is interposed between this bracket leg and the cylinder head surface 54.

Threaded fasteners 77 are passed into tapped openings 78 formed in the cylinder head casting 15. The fuel rail 66 is formed with a pair of reliefs 79 adjacent the heads of the fasteners 77 so as to facilitate their access.

It should be noted that the cylinder head casting has a portion 81 that extends inwardly toward the head bolt opening 18. These tapped openings 78 extend into this portion but do not penetrate it. This projection 81 is such that it will not obscure the access to the head of the fastener which affixes the cylinder head casting 15 to the cylinder block and which engages a machined surface 82 formed on the upper side of the cam chamber portion of the cylinder head casting 15.

Because the axes of the tapped openings 78 is parallel to the axis of the tapped opening 58 that receives the manifold fasteners 57, machining is simplified and can be done with a gang drill. Also, it should be noted that the axes of the fasteners 77, indicated at 83 in FIG. 3, are parallel to the axes 84 of the manifold runner 55 and the inlet portion of the intake passages 19. Thus, setup time is facilitated also with this arrangement.

Thus, from the foregoing description, it should be readily apparent that the described cylinder head construction permits the attachment of the intake manifold and the fuel rail in close proximity to each other without interference and in such a manner as to simplify machining. Of course, the foregoing description is that of a preferred embodiment of the invention and various changes and modifications may be made without departing from the spirit and scope of the invention, as defined by the appended claims.

What is claimed is:

1. A fuel injected internal combustion engine comprised of a cylinder head having a plurality of intake passages, an air intake manifold attached to said cylinder head for supplying air to said cylinder head intake passages, a plurality of fuel injectors mounted in said cylinder head and positioned in proximity to said intake passages for spraying fuel directly into said intake passages, and a fuel rail for supplying fuel to said fuel injectors, said fuel rail being affixed to said cylinder head in proximity to said air intake manifold, said fuel rail being connected to said cylinder head by threaded fasteners that are disposed in the area between said fuel injectors and said air intake manifold so that said threaded fasteners for said fuel rail do not interfere with the attachment of said intake manifold to said cylinder head.

2. A fuel injected internal combustion engine as set forth in claim 1 wherein the threaded fasteners for affixing the fuel rail to the cylinder head are disposed at a different angle to a supporting surface of the cylinder head than the axis of the fuel injector.

3. A fuel injected internal combustion engine as set forth in claim 2 wherein the angle of the threaded fasteners to the cylinder head surface is inclined toward the intake manifold relative to the axis of the fuel injector.

4. A fuel injected internal combustion engine as set forth in claim 3 wherein the threaded fasteners are perpendicular to the cylinder head surface and the axis of the fuel injector is inclined away from the intake manifold.

5. A fuel injected internal combustion engine as set forth in claim 2 wherein the threaded fasteners are parallel to the axes of the intake passages.

6. A fuel injected internal combustion engine as set forth in claim 1 wherein the fuel rail is affixed to the cylinder head by at least one angularly shaped bracket having a first leg affixed to one side of said fuel rail and a second leg which cooperates with the threaded fasteners for affixing said bracket to said cylinder head.

7. A fuel injected internal combustion engine as set forth in claim 1 wherein the fuel rail is affixed to a cylinder head surface that is juxtaposed to and substantially parallel with the surface of the cylinder head to which the air intake manifold is attached.

8. A fuel injected internal combustion engine as set forth in claim 7 wherein the threaded fasteners for affixing the fuel rail to the cylinder head are disposed at a different angle to the cylinder head surface than the axis of the fuel injector.

9. A fuel injected internal combustion engine as set forth in claim 8 wherein the angle of the threaded fasteners to the cylinder head surface is inclined toward the intake manifold relative to the axis of the fuel injector.

10. A fuel injected internal combustion engine as set forth in claim 9 wherein the threaded fasteners are perpendicular to the cylinder head surface and the axis of the fuel injector is inclined away from the intake manifold.

11. A fuel injected internal combustion engine as set forth in claim 7 wherein the threaded fasteners are parallel to the axes of the intake passages.

12. A fuel injected internal combustion engine as set forth in claim 11 wherein the fuel rail is affixed to the cylinder head by at least one angularly shaped bracket having a first leg affixed to one side of said fuel rail and a second leg which cooperates with the threaded fasteners for affixing said bracket to said cylinder head.

13. A fuel injected internal combustion engine as set forth in claim 1, further including a camshaft journaled in the cylinder head and juxtaposed to the fuel rail so that the fuel rail is disposed between the air intake manifold and the camshaft.

14. A fuel injected internal combustion engine as set forth in claim 13, wherein the threaded fasteners are received in tapped openings formed in a wall of the cylinder head, said wall being juxtaposed to but spaced transversely outwardly from a surface of said cylinder head that is engaged by a further threaded fastener for affixing said cylinder head to an associated engine body.

15. A fuel injected internal combustion engine as set forth in claim 1, wherein the threaded fasteners are received in tapped openings formed in a wall of the cylinder head, said wall being juxtaposed to but spaced transversely outwardly from a surface of said cylinder head that is engaged by a further threaded fastener for affixing said cylinder head to an associated engine body.

* * * * *